United States Patent [19]

Warner

[11] Patent Number: 4,498,204

[45] Date of Patent: Feb. 12, 1985

[54] ADJUSTABLE POSITION PHYSICAL SUPPORT SYSTEM

[76] Inventor: Stanley H. Warner, 1621 W. Onondaga St., Syracuse, N.Y. 13204

[21] Appl. No.: 534,157

[22] Filed: Sep. 21, 1983

[51] Int. Cl.[3] ..... A47K 3/00

[52] U.S. Cl. ..... 4/559; 4/571; 4/576; 4/605; 4/611; 4/254

[58] Field of Search ..... 4/576, 571, 577, 605, 4/661, 611, 559, 254; 272/93, 70; 5/81

[56] References Cited

U.S. PATENT DOCUMENTS

| | | | |
|---|---|---|---|
| 2,243,794 | 5/1941 | Dunn | 4/576 |
| 2,513,619 | 7/1950 | Bennett | 4/577 |
| 2,549,506 | 4/1951 | Moore | 4/576 |
| 2,818,577 | 1/1958 | Kubik et al. | 4/611 |
| 3,114,154 | 12/1963 | Laughlin | 4/576 |
| 3,448,468 | 6/1969 | Murcott | 4/577 |
| 3,996,631 | 12/1976 | Fields | 4/576 |
| 4,361,914 | 12/1982 | Oliver | 4/605 |

*Primary Examiner*—Henry K. Artis
*Attorney, Agent, or Firm*—Charles S. McGuire

[57] ABSTRACT

A support system is disclosed which is primarily intended to provide a sturdy and convenient means to be manually grasped by a handicapped or infirm person while raising or lowering themselves, moving from place to place, or simply to provide support in a given position. The basic component of the system is a vertical pole made up of at least two hollow, elongated rods, one of which is telescoped axially into the other. Bottom and top plates on opposite ends of the pole provide parallel, non-slip surfaces for frictional engagement between floor and ceiling, or other horizontal surfaces, with the top plate preferably having a surface much larger than that of the bottom plate. The upper and lower telescoping rods are joined by two distinct connecting means; one such connecting means movable between engaged and disengaged positions wherein relative axial, sliding movement of the two rods is, respectively, prevented and permitted to bring the pole assembly quickly to the approximate desired length, while the other is a threaded connection for making finer length adjustments and frictionally engaging the pole at a desired location. Horizontal bars and/or manual grip rings may be positioned at any desired height, supported by frictional clamp-type support means on two or more of such pole assemblies.

10 Claims, 6 Drawing Figures

ADJUSTABLE POSITION PHYSICAL SUPPORT SYSTEM

BACKGROUND OF THE INVENTION

The present invention relates to movable support systems, primarily for assisting in support and movement of individuals such as handicapped or infirm persons. More specifically, the invention relates to physical support systems including length-adjustable vertical rods with other support elements optionally attached thereto.

The prior art includes numerous examples of support bar systems, whether for exercise and gymnastic use by athletes or simply for assisting in the physical support of infirm or handicapped individuals. Some such systems are self-supporting, i.e., they have a base structure upon which the entire support system rests, others are partly or fully supported by guy-wires or other laterally extending support means, while still others are supported at both the top and bottom, as by permanent or temporary engagement between floor and ceiling.

In a support system for assisting individuals to stand, sit, rise, etc. at various locations about their residence, an important attribute is ease and speed of installation. It is also desireable that the support system, although being strong and rigid when installed, by easily moved from one location to another without leaving marks or blemishes in the former location. It is further desireable that the support system be versatile, providing a number of optional support features without becoming unduly complicated or expensive.

It is the object of the present invention to provide a novel and improved support system having the above-enumerated features and advantages.

Other objects will in part be obvious and will in part appear hereinafter.

SUMMARY OF THE INVENTION

The basic unit of the present support system is a vertical pole comprising a pair of telescoping rods connected for axial adjustment, having top and bottom plates affixed to the opposite ends. The rods are joined by two distinct connecting means, one providing rapid axial adjustment to an approximate desired length by relative sliding movement of the two rods, and the other a slower but finer adjustment by relative rotational movement of threaded portions of the pole assembly.

The top and bottom plates are provided with surfaces of rubber, or other such material for engaging the floor and ceiling to provide a high degree of friction with some resilience to lessen the possibility of scratching, scuffing, or otherwise marring the surface. Since ceilings do not normally have significant load-bearing requirements, they are usually constructed of materials more fragile than those used in floors. The present invention includes a top plate having a relatively large surface area, e.g., ten times or more than the area of the bottom plate, to distribute the load over a correspondingly large surface area.

Optional support features include friction clamps which may be placed in encircling relation to the vertical poles at any of one or more desired heights. These clamps may be used to support horizontal bars or rails extending between two spaced vertical poles, and/or to support hand grips in the form of suspended rings, or the like. The vertical position of the clamps may be easily and quickly adjusted by loosening and tightening manually engageable knobs.

DETAILED DESCRIPTION

Figure 2:
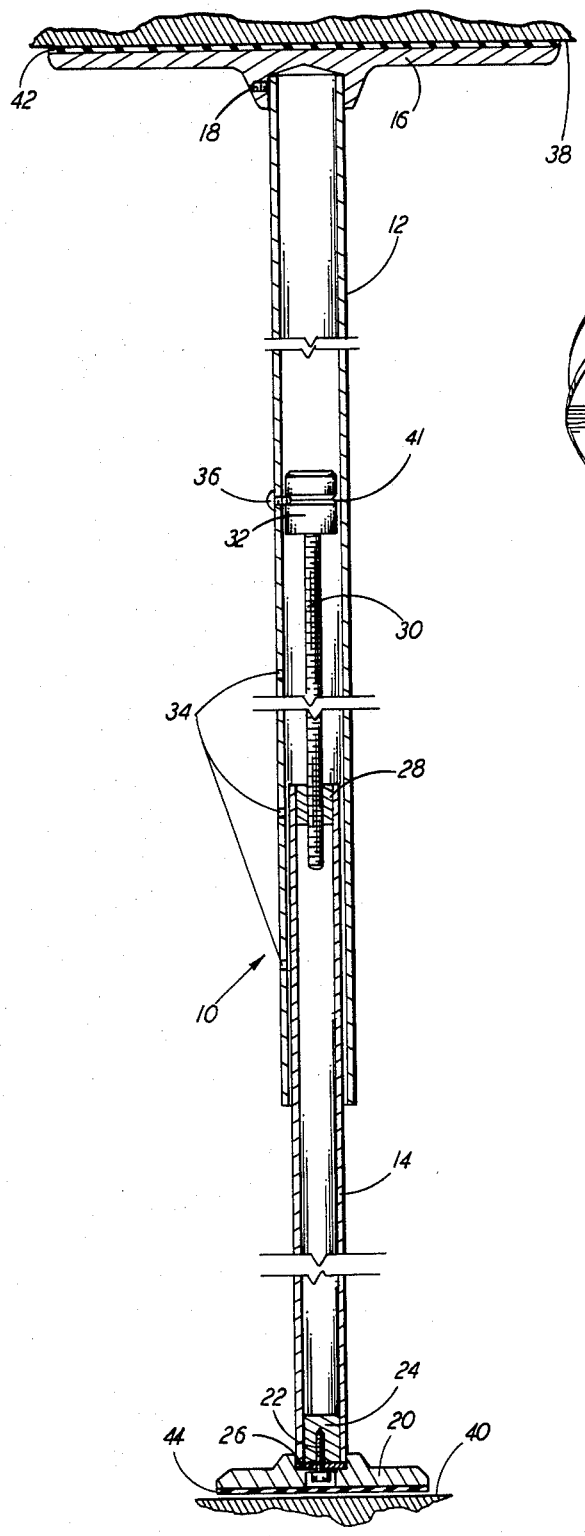
FIG. 2 is an elevational view of the pole assembly of FIG. 1 in vertical half-section.
Figure 1:
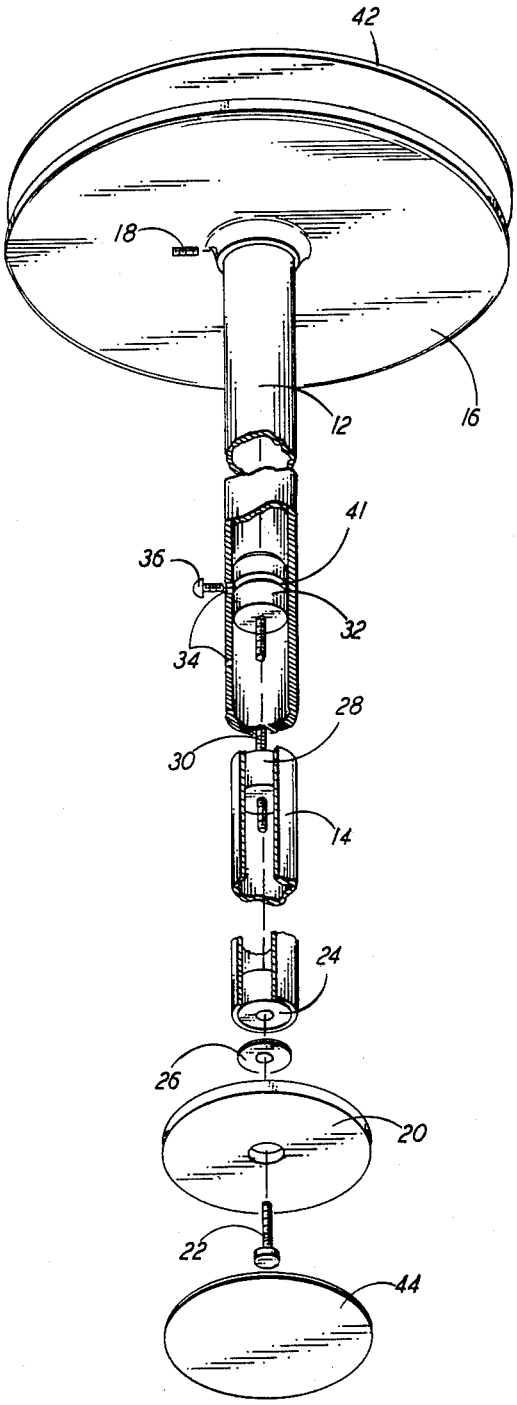
FIG. 1 is a fragmentary, exploded, perspective view, with portions broken away, of the pole assembly of the invention.

Referring now to the drawings, the basic element of the support system is a pole assembly, denoted generally by reference numeral 10, and including a pair of hollow, elongated, cylindrical tubes or rods 12 and 14. Rod 12 has an inside diameter slightly greater than the outside diameter of rod 14 to permit coaxial, telescoping engagement of the two. When installed for use, in the manner explained later herein, the rods are vertically oriented with larger diameter tube 12 being the upper rod in the illustrated embodiment, and terms such as top, bottom, upper, lower, etc. being used hereinafter to refer to positional relationships when pole assembly 10 is so installed.

Top plate 16 is secured to the upper end of rod 12 by set screw 18. Bottom plate 20 is rotatably secured to the lower end of rod 14 by shoulder screw 22 which extends through a central opening within a recess in the lower side of the bottom plate for threaded engagement in insert 24 which is press-fitted, welded, or otherwise fixedly secured within the lower end of rod 14. Thrust washer 26 is positioned between the lower end of rod 14 and a recess in the upper side of bottom plate 20 into which it extends, screw 22 also passing through an opening in washer 26.

Internally threaded insert 28 is welded or otherwise affixed within the upper end of rod 14. Adjustment screw 30 is threaded into insert 28 and extends upwardly therefrom within rod 12 to an upper end which is inserted into an opening in locking head 32 and fixedly attached thereto by conventional means. A plurality of openings 34 are provided at spaced positions along an axial line on rod 12. Screw 36 extends through one of openings 34 and is engaged in a threaded opening in locking head 32.

When installed for use, pole 10 is engaged between horizontal upper and lower fixed surfaces 38 and 40, respectively, normally the ceiling and floor of a room. In the normal manner of installation, top and bottom plates 16 and 20 will be attached in the indicated manner and rod 14 will be inserted in rod 12 with screw 36 removed, permitting relative, axial, sliding movement of the two rods. With bottom plate 20 resting on surface 40, rod 12 will be moved upwardly until the threaded opening in locking head 32 is aligned with the highest of openings 34 possible before top plate 16 contacts upper surface 38. Scribe mark 41, or other visible indicia may be provided on locking head 32 to facilitate visual alignment of the opening in the locking head with corresponding opening 34.

Screw 36 is then inserted through opening 34 and threaded into engagement with locking head 32, thus fixing the relative rotational positions of rod 12 and locking head 32, and of adjustment screw 30 affixed thereto. Relative rotation of rods 2 and 14 will then change the overall length of pole assembly 10 by advancing adjusting screw 30, which is rotationally and axially fixed to rod 12, into or out of threaded insert 28, which is likewise fixed to rod 14. Either or both of rods 12 and 14 are manually rotated in the proper directions to effect lengthening of the pole assembly until top plate 16 comes into contact with surface 38.

The pole assembly is then brought to tight frictional engagement between surfaces 38 and 40 by continued manual rotation of rod 14 since the latter may be rotated with bottom plate 20 remaining stationary, while top plate 16 is rotationally fixed to upper rod 12 by set screw 18. Pads 42 and 44 of a high-friction, non-slip and non-marring material, such as $\frac{1}{8}''$ thick open cell sponge rubber, provide the upper and lower surfaces of top and bottom plates 16 and 20, respectively, which contact surfaces 38 and 40.

Since surface 38 will normally be the ceiling of a room, and thus have significantly lower load-bearing capacity than surface 40, normally the floor, it is preferred that the area of the upper surface of top plate 16 be much larger than that of the lower surface of bottom plate 20. For example, the diameters of upper and lower plates 16 and 20 may be, respectively, $17\frac{1}{2}''$ and $4\frac{3}{4}''$, making the contact surface area at the top on the order of ten times that at the bottom. The pole may then be tightened to a high degree of frictional engagement with the upper and lower surfaces without danger of damaging or marring either surface.

Figure 3:
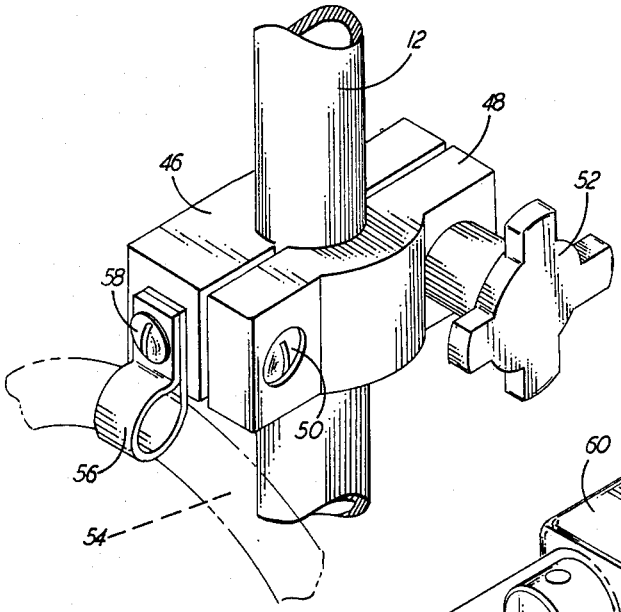
FIGS. 3 and 4 are fragmentary, perspective views of portions of the pole assembly of FIGS. 1 and 2 with additional elements attached thereto for support of further apparatus shown in dot-dash lines.
Figure 4:
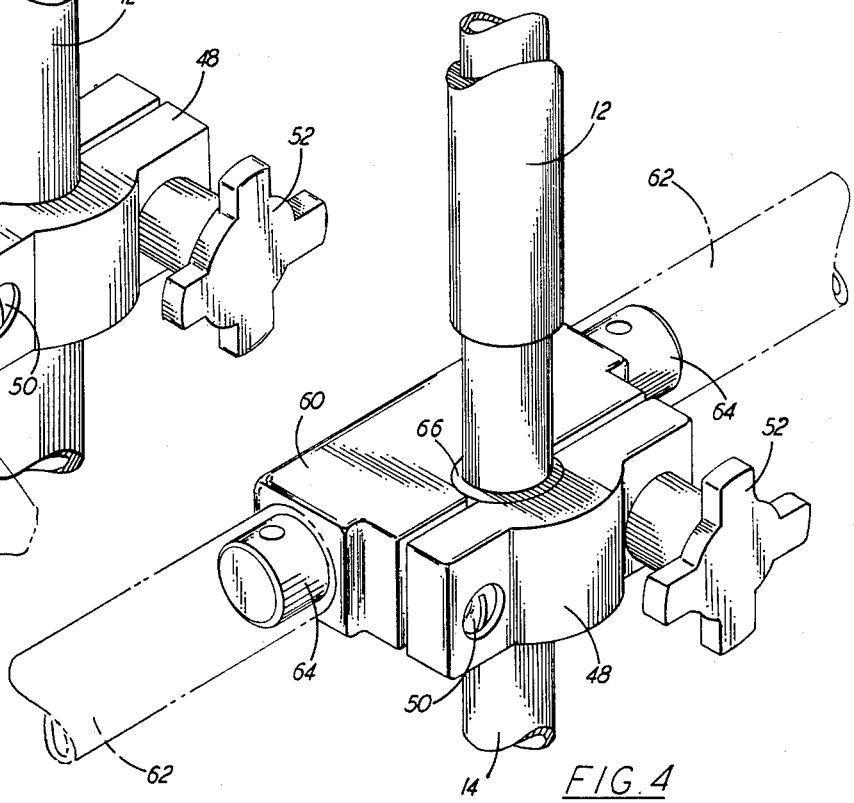

Turning now to FIGS. 3 and 4, additional support elements which may optionally be attached to pole assemblies 10 are illustrated. In some circumstances it may be desireable to have horizontal bars extending between certain points in a room, and/or to have handle means such as grip rings, or the like, suspended at selected locations. For this purpose, friction clamps are provided for attachment to pole assemblies 10 at desired vertical locations.

The clamp of FIG. 3 comprises body 46 and strap 48 having facing surfaces of the same radius of curvature as the outside diameter as upper rod 12, each slightly less than a complete semi-circle to provide a space or gap between the two elements on each side of the rod. Screw 50 is inserted through a hole in strap 48 into a threaded opening in body 46. Manually engageable knob 52 is attached to a threaded stud which likewise extends through strap 48 into a threaded opening in body 46. Handle 54, of circular or other desired configuration, provides a grip ring suspended from clip 56 which is attached by screw 58 to clamp body 46.

Common reference numerals are used for elements of the clamp assembly of FIG. 4 which, in the illustrated embodiment, are common to those of FIG. 3. Clamp body 60 is designed to support horizontal bars 62 at one or both sides. Strap 48 of the bar clamp assembly is the same as that of the handle clamp assembly and is likewise attached to the body by screw 50 and the threaded stud of manual adjustment knob 52. Support is provided by protruding portions 64 on each side of body 60 extending into the hollow interior of horizontal bars 62. When either of the clamp assemblies is to be supported on rod 14 rather than rod 12, the difference in diameters is compensated for by sleeve 66 which has some degree of flexibility to permit tight frictional engagement with the rod when knob 52 is turned to tighten the clamp.

Figure 5:
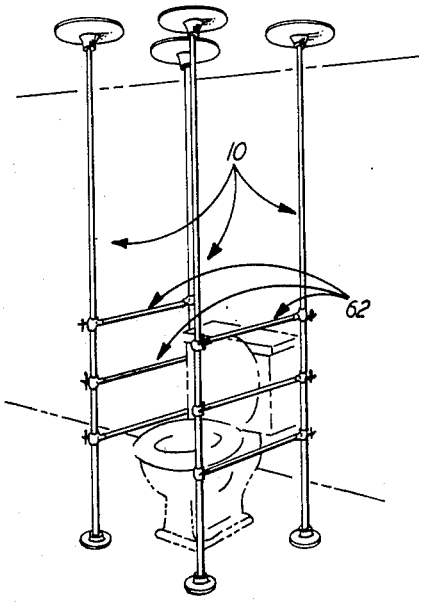
FIGS. 5 and 6 are perspective views showing typical applications of the support system of the invention.
Figure 6:
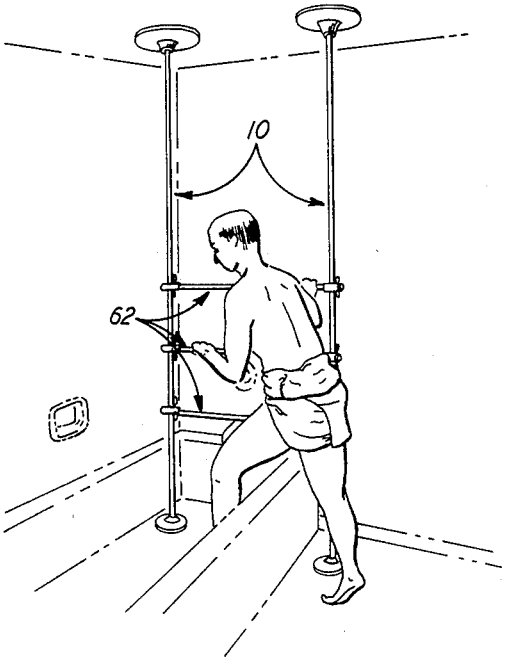

Two typical applications of the apparatus of the invention are illustrated in FIGS. 5 and 6. Besides providing useful means of support in the environment of bathroom fixtures, the apparatus may be employed with equal advantage in any household location. In fact, the pole assemblies may be utilized to support other apparatus which is provided with friction clamps or other means of attachment to the poles, such as seats, back rests, and the like.

What is claimed is:

1. A support device for installation between the floor and ceiling of a room, said support device comprising, in combination:

(a) a pair of elongated, hollow rods, arranged for coaxial, telescoping, relative axial movement;

(b) a first plate affixed to the non-telescoping end of one of said rods and having a planar surface of a first area normal to the axis of said rods;

(c) a second plate affixed to the non-telescoping end of the other of said rods and having a planar surface of a second area parallel to said first plate planar surface;

(d) means defining an internally threaded opening in the telescoping end of one of said rods;

(e) an elongated, externally threaded member having a first end threadedly inserted into said internally threaded opening to extend coaxially into the telescoping end of the other of said rods; and (f) connecting means for rigidly affixing said externally threaded member and said other rod in any of a plurality of relative axial positions, whereby the overall length of said pair of rods is selectively adjustable by a combination of the axial position at which said externally threaded member and said other rod is affixed and the rotational movement of said externally threaded member into and out of said internally threaded opening, to permit said first and second plates to be rapidly adjusted to a desired axial length and advanced into tight frictional, non-piercing, engagement with the floor and ceiling, respectively of the room in which said support device is installed.

2. The invention according to claim 1 wherein said second area is significantly greater than said first area.

3. The invention according to claim 2 wherein said second area is at least ten times said first area.

4. The invention according to claim 3 wherein both said first and second plate planar surfaces are covered with a high-friction, non-slip material.

5. The invention according to claim 1 wherein said connecting means comprise a plurality of axially spaced openings in said other rod and a locking member extending through a selected one of said openings and engaged with said externally threaded member.

6. The invention according to claim 5 wherein said locking member comprises a screw engaged with said externally threaded member.

7. The invention according to claim 1 and further including at least two of said support devices installed in spaced, parallel relation, and at least one horizontal bar extending between said rods of said devices and attached thereto by support means at a selectively adjustable vertical position.

8. The invention according to claim 7 wherein said support means comprise a frictional clamp encircling one of said elongated rods of each of said pair of devices and having a manually engageable knob for tightening and loosening the frictional engagement between said clamps and rods.

9. The invention according to claim 8 and further including a manual grip ring attached to one of said elongated rods by support means at a selectively adjustable vertical position.

10. The invention according to claim 9 wherein said support means comprise a frictional clamp encircling one of said elongated rods and having a manually engageable knob for tightening and loosening the frictional engagement between said clamps and rods.

* * * * *